United States Patent [19]

Buck et al.

[11] 4,436,696

[45] Mar. 13, 1984

[54] PROCESS FOR PROVIDING A UNIFORM CARBON DISTRIBUTION IN FERROUS COMPACTS AT HIGH TEMPERATURES

[75] Inventors: Daniel M. Buck; Alan T. Sibley, both of Allentown; John J. Kaiser, Catasauqua, all of Pa.

[73] Assignee: Air Products and Chemicals, Inc., Allentown, Pa.

[21] Appl. No.: 265,512

[22] Filed: May 20, 1981

[51] Int. Cl.[3] ..... B22F 3/00

[52] U.S. Cl. ..... 419/57; 252/376; 419/58; 419/59

[58] Field of Search ..... 75/224, 246, 200; 252/376, 374, 372, 375; 148/16.7; 419/57, 58, 59

[56] References Cited

U.S. PATENT DOCUMENTS

| | | | |
|---|---|---|---|
| 4,016,011 | 4/1977 | Asai et al. | 148/16 |
| 4,028,100 | 6/1977 | Latva | 75/224 |
| 4,106,931 | 8/1978 | Nayar | 75/224 |
| 4,139,375 | 2/1979 | Solomon et al. | 75/224 |
| 4,153,485 | 5/1979 | Ogata et al. | 148/126 |
| 4,154,629 | 5/1979 | Asai | 148/16.7 |
| 4,322,255 | 3/1982 | Kosbelitz | 148/16.7 |

OTHER PUBLICATIONS

"High Temperature Sintering of Ferrous Powder Parts," Moscarski et al., *Metal Progress,* Dec. 1979, pp. 50–56.

"Nitrogen-Base Heat Treating at Platt Saco Lowell," Russell; R. W., *Metal Progress,* Dec. 1979, pp. 46–49.

S. Mocarski et al., "High Temperature Sintering of Ferrous Powder Metal in Nitrogen Base Atmospheres," pp. 375–400.

J. R. Herhar, "The Application of High Temperature Sintering in the Production of P/M Components.

*Primary Examiner*—L. Dewayne Rutledge
*Assistant Examiner*—J. J. Zimmerman
*Attorney, Agent, or Firm*—Michael Leach; E. Eugene Innis; James C. Simmons

[57] ABSTRACT

A process for high temperature sintering of ferrous powder metallurgy compacts having a substantially uniform carbon distribution which comprises:

(a) heating the ferrous powder metallurgy compact in the heating zone of a sintering furnace to a temperature of about 2,300° to 2,550° F. (1,260° to 1,399° C.), (b) introducing to the heating zone an atmosphere comprising about 2 to less than 10 volume percent hydrogen, about 0.5 to 2.0 volume percent carbon monoxide, about 0.5 to 1.0 volume percent methane and the balance nitrogen, and (c) removing the sintered product from the furnace.

8 Claims, No Drawings

PROCESS FOR PROVIDING A UNIFORM CARBON DISTRIBUTION IN FERROUS COMPACTS AT HIGH TEMPERATURES

TECHNICAL FIELD

The present invention relates to a method for sintering powder metallurgy parts. More particularly, the invention relates to a method for the high temperature sintering of ferrous powder metallurgy compacts in nitrogen based atmospheres.

BACKGROUND OF THE INVENTION

The production of most powder metallurgy parts involves two major steps: compaction and sintering. The compacted, or green, parts are fragile unless sintered.

Sintering is the process of heating a green compact, usually in a protective atmosphere, to a temperature below its melting point to cause its particles to bond together. The mechanism is based upon the diffusion of metal atoms between the individual powder particles.

The process typically comprises passing the green powder metallurgy compacts through a sintering furnace comprised of a pre-heat section, a high-temperature (hot zone) section and a cooling section which sections are supplied with a protective atmosphere. Conventional sintering temperatures in the hot zone commonly range from about 2,000° to 2,100° F. (1,093° to 1,149° C.) due to the limitations of the materials used in common sintering furnaces.

Probably the most widely used protective atmosphere to date is endothermic gas which comprises about 40% nitrogen, about 20% carbon monoxide, and about 40% hydrogen. Endothermic gas is generated by the controlled partial oxidation of natural gas or other hydrocarbon sources. Sintering under high quality endothermic gas at a temperature of about 2,050° F. (1,121° C.) provides an acceptable carbon potential.

Exothermic gas which is generated from burning about 6 parts of air with 1 part of natural gas and subsequently removing carbon dioxide and moisture is also used as a protective atmosphere in sintering processes. This atmosphere comprises about 75% nitrogen, 11% carbon monoxide and about 13% hydrogen. Exothermic gas is usually used as a protective atmosphere during sintering of powder metallurgy parts only when carbon potential is not important.

Dissociated ammonia which comprises 25% nitrogen and 75% hydrogen is also used as a protective sintering atmosphere. For sintering carbon containing compacts, however, dissociated ammonia suffers from a drawback in that it contains no hydrocarbon constituents to counteract decarburization.

More recently, the trend has been towards the use of protective atmospheres comprising predominantly nitrogen to which controlled amounts of other gaseous components such as carbon monoxide, hydrogen, hydrocarbons and even water have been added. U.S. Pat. Nos. 4,016,011; 4,106,931; and 4,139,375 are representative.

U.S. Pat. No. 4,016,011 discloses a method for the heat treatment of a high-alloy steel article in an atmosphere comprising 0.5 to 1.5% carbon monoxide, 0.5 to 2.5% hydrogen, and a small amount of active carbon with the remainder being nitrogen. The atmosphere is generated by the thermal cracking of a liquid organic compound such as isopropanol or methyl acetate. Heat treating temperatures of 1,000° to 1,200° C. and up are mentioned.

U.S. Pat. No. 4,106,931 describes a method for sintering carbon steel powder metallurgy parts having a density of less than 90% theoretical density and 0.3 to 1.3% carbon in the form of graphite. The part is heated in a hot zone to a temperature of at least 2,000° F. in a controlled atmosphere of at least 90% nitrogen, up to 9.75% hydrogen and carbon monoxide, with the carbon monoxide being less than 5.0%; 0.25 to 2% methane or equivalent hydrocarbon and a dew point of less than −60° F.

U.S. Pat. No. 4,139,375 discloses sintering powder metal parts in a furnace having 2 successive zones, one of which is an upstream zone maintained at a temperature in the range of about 800° to 2,200° F. A gaseous mixture consisting essentially of methanol and nitrogen is introduced into the upstream zone at a point where a temperature of at least about 1,500° F. is maintained. The methanol and nitrogen are in a ratio sufficient to provide an atmosphere comprising about 1 to 20% carbon monoxide, about 1 to 40% hydrogen and the balance nitrogen. It is suggested that amounts of an enriching gas such as methane or other hydrocarbons be introduced into the atmosphere in a range from about 1 to 10%.

A goal of any sintering process is the minimization of decarburization in the core of the metallurgical part along with control of surface carbon for improved strength, size control and aesthetic features such as surface luster.

However, it is nevertheless customary and accepted to sustain a maximum of about 0.15 to 0.20% carbon loss with respect to parts formed of atomized or sponge-type powders. Accordingly, if carbon is present in the green compact at a level of 0.9% as graphite, an acceptable part after the sintering process would have a core that is at least 0.7% carbon. The function of the protective atmosphere is to prevent further carbon loss.

A further goal in the sintering process is to prevent excess carburization of the compacts. Excessive carbon potential of the atmosphere can result in a degradation of physical properties caused by iron carbides and also in soot deposition on the compacts and in the furnace.

Representative of literature references extolling high temperature sintering is J. R. Merhar, "The Application of High Temperature Sintering in the Production of P/M Components," Hoeganaes P/M Technical Conference, Philadelphia, Pa. 1978 which indicates that the temperature at which parts are sintered may have the greatest influence on mechanical properties, and that the sintering atmosphere selected may also have a subtle influence on properties. Increasing temperatures above the conventional 2,050° F. can improve mechanical properties such as impact strength and the ductility of stainless steel powder compacts.

However, problems including the above-described decarburization and surface carbon loss of the metallurgy part, which are encountered in sintering processes at conventional temperatures of about 2,000° to 2,100° F. (1,093° to 1,149° C.), are substantially magnified if high temperatures above 2,200° F. (1,204° C.) are employed. Sintering at such high temperatures enhances the decarburizing rate of hydrogen, carbon dioxide, oxygen and water found in conventional furnace atmospheres. The result is an excessive carbon loss from the powder metallurgy compact. Conventional furnace atmospheres which contain hydrocarbons can cause excessive carbon pick-up, or recarburization, due to the high carburizing rates at these higher temperatures.

Atmosphere control and purity are extremely critical at temperatures greater than 2,200° F. (1,204° C.). An endothermic gas atmosphere may not provide sufficient carbon potential. The resulting decarburization from the excessive carbon dioxide and water in endothermic gas can render it impractical for high temperature sintering.

In sum, the difficulties encountered in controlling recarburization or decarburization when using prior art protective atmospheres at the conventional sintering temperatures became even more pronounced at the higher sintering temperatures of greater than about 2,200° F.

S. Mocarski et al., "High Temperature Sintering of Ferrous Powder Metal in Nitrogen Base Atmospheres," Metal Progress, December 1979 disclose a nitrogen base atmosphere comprising 96 parts nitrogen and 4 parts hydrogen with a small addition of carbon monoxide or methane.

SUMMARY OF THE INVENTION

We have discovered a process for sintering ferrous powder metallurgy compacts at temperatures of at least 2,200° F. (1,204° C.) that provides metal parts having a substantially uniform carbon distribution. The process for such high temperature sintering of ferrous powder metallurgy compacts of a medium to high combined carbon content of at least 0.4% comprises:

(a) heating the ferrous powder metallurgy compact in the heating zone of a sintering furnace to a temperature of at least 2,200° F. (1,204° C.), (b) introducing to the heating zone an atmosphere comprising about 2 to less than 10 volume percent hydrogen, about 0.5 to 2.0 volume percent carbon monoxide, about 0.5 to 1.0 volume percent methane and the balance nitrogen, and (c) removing the sintered product.

This process provides an ability to maintain the carbon level of the ferrous metal compact while achieving a substantially uniform carbon profile. The preferred sintering temperature ranges from about 2,300° to 2,550° F. (1,260° to 1,399° C.) with a temperature of about 2,350° F. (1,288° C.) most preferred. It is preferred that the hydrogen content of the protective atmosphere range from about 2 to 6 volume percent and, most desirably from about 2 to 4.5 volume percent.

While methane is one of the gaseous components composing the protective atmosphere, we contemplate functional equivalents of methane to include almost any hydrocarbon material such as natural gas, ethane, propane and the like. The effective quantity of each such hydrocarbon material in the protective atmosphere, as related to the methane range of about 0.5 to 1.0 volume percent, is in proportion to its carbon content. The quantity of propane, for example, would range from about 0.1 to 0.4 volume percent.

Advantageously, the high temperature sintering atmosphere of the above process is provided to the sintering furnace by introducing a mixture of nitrogen, methanol and about 0.5 to 1.0 volume percent methane, or its functional equivalent, to the heating zone of the furnace. The nitrogen and methanol are in such proportion as to afford, when subjected to the high temperature, a protective atmosphere comprising hydrogen, carbon monoxide, methane and nitrogen in the above designated volume percent ranges.

DETAILED DESCRIPTION OF THE INVENTION

The use of protective atmospheres comprising about 2 to less than 10% hydrogen, 0.5 to 2% carbon monoxide, and 0.5 to 1% methane with the balance being nitrogen has been found to provide carbon control and essentially uniform carbon distribution in ferrous powder metallurgy compacts of medium to high combined carbon content of about 0.4% to 0.8% or greater which were sintered at high temperatures above about 2,200° F. (1,204° C.). It is preferred that the hydrogen content of the sintering protective atmosphere be about 2 to 6% with the range of 2 to 4.5% most preferred. The preferred temperature range for high temperature sintering process is 2,300° to 2,550° F. (1,260° to 1,399° C.).

The protective atmosphere used in the process of this invention may be blended from separate sources of the individual gases and then conveyed into the sintering furnace. Alternatively, the atmosphere may be generated in the furnace by the introduction of a nitrogen, methanol and methane blend. The proportions of nitrogen, methanol and methane are such as to yield, upon the dissociation of the methanol at the sintering temperatures, about 2 to less than 10 percent hydrogen, about 0.5 to 1.0 percent methane, about 0.5 to 2.0 percent carbon monoxide and the balance nitrogen. The process of this invention provides control of the surface carbon while also providing substantially uniform carbon distribution throughout the metallurgy part. For the purposes of this invention we define uniform carbon distribution to mean a uniform distribution of pearlite and ferrite without the presence of hypereutectoid carbides as determined through conventional metallographic analysis. Acceptable uniformity is exemplified by a compact in which carburization or decarburization does not alter carbon content by more than ±0.05% throughout the compact. Further, this uniform carbon content should be within 0.05% of the desired carbon content defined by the design of the compact.

The protective atmospheres used in the process of this invention are designed to provide a low carbon monoxide level and a small quantity of hydrocarbon to promote uniform carbon distribution in the sintered compact. The carbon monoxide provides a moderate carburizing potential at high temperatures and the small amount of hydrocarbon eliminates the decarburizing tendency of any carbon dioxide, oxygen and water which may be present in the atmosphere as a result of the green compact, furnace leaks or gaseous impurities in the protective atmosphere.

As previously stated, sintering at high temperatures enhances the decarburizing rate of hydrogen, carbon dioxide, oxygen and water found in conventional furnace atmospheres which results in excessive carbon loss. Conventional furnace atmospheres which contain hydrocarbons cause excessive carbon pick-up, or recarburization, due to the high carburizing rates at these high temperatures. This recarburization can be explained by the temperature dependence of the equilibrium constants for the carburizing reactions shown in Table I.

TABLE I

| | 1500° F. (815° C.) | 2300° F. (1260° C.) |
|---|---|---|
| 1. $CO + H_2 \rightleftarrows H_2O + C$ | $K_1 = 0.105$ | $1.16 \times 10^{-3}$ |
| 2. $2CO \rightleftarrows CO_2 + C$ | $K_2 = 0.112$ | $4.13 \times 10^{-4}$ |
| 3. $CH_4 \rightleftarrows 2H_2 + C$ | $K_3 = 2.49 \times 10^{+1}$ | $5.28 \times 10^{+2}$ |

At 1,500° F. (815° C.), reactions 1 and 2 have similar equilibrium constants, 0.105 and 0.112, respectively. As temperature increases, $K_2$ decreases, with a corresponding decrease in equilibrium carbon level, more rapidly than does $K_1$. At 2,300° F. (1,260° C.), $K_2$ is much lower than $K_1$. Thus, at the component concentrations used in the protective atmospheres of the process of this invention, the level of carburization possible by carbon monoxide alone is considerably lower than the level which is possible by carbon monoxide in combination with hydrogen. This implies that small amounts of carbon monoxide and hydrogen in the atmosphere can be effective for maintaining carbon in a material.

The equilibrium constant for reaction 3, however, increases significantly with temperature. Therefore carburization by methane increases at higher temperatures. This implies that a small amount of methane is sufficient to maintain carbon and counteract the decarburizing tendencies of carbon dioxide, hydrogen, oxygen and water in the atmosphere.

Accordingly, the constitution of the protective sintering atmosphere must be maintained within the volume percent ranges specified for hydrogen, carbon monoxide, and the hydrocarbon in order to maintain the carbon level of the ferrous powder metallurgy compact within desired limits and to provide substantially uniform carbon distribution. Too low a level of hydrogen would result in oxidation of the material; too high a level of hydrogen would result in decarburization by the reverse of reaction 3. In contrast, too high a level of carbon monoxide or hydrocarbon would result in recarburization while too low a level of carbon monoxide or hydrocarbon would result in decarburization. The disclosed sintering protective atmospheres provide the proper amounts of the gaseous components which afford uniform carbon distribution, i.e., essentially no recarburization or decarburization of the material.

With respect to the following examples which demonstrate the inventive process for carbon control and substantially uniform carbon distribution during the high temperature sintering of ferrous powder metallurgy parts, test bars were pressed from 4 different ferrous powder alloys, the compositions of which are shown in Table II.

TABLE II

| ALLOY | POWDERS | Alloy Composition (wt %) C | Mn | S | P | Mo | Ni | $O_2$ | Fe |
|---|---|---|---|---|---|---|---|---|---|
| 1 | Ancorsteel ® 2000 + 0.7% Graphite | 0.02 | 0.30 | 0.017 | 0.013 | 0.60 | 0.45 | 0.17 | Bal |
| 2 | Ancorsteel ® 1000 + 0.9% Graphite | 0.02 | 0.20 | 0.018 | 0.01 | | | 0.17 | Bal |
| 3 | Ancorsteel ® 1000 + 0.7% Graphite + 4.0% Ni | 0.02 | 0.20 | 0.018 | 0.01 | | | 0.17 | Bal |
| 4 | Ancorsteel ® 1000 + 0.9% Graphite + 2.0% Cu | 0.02 | 0.20 | 0.018 | 0.01 | | | 0.17 | Bal |

® Ancorsteel is a registered trademark of the Hoeganaes Corporation.

For pressing the test bars, 1% zinc stearate was added as a lubricant. All pressed bars complied with ASTM specifications for size and density for testing transverse rupture strength and tension, ASTM B 378-61T, 1961 and E8-61T, 1961, respectively.

To insure consistent lubricant burn-off and to minimize lubricant build-up in the sintering furnace, the test bars were pre-sintered in a conventional 6 inch (0.152 m) belt-muffle furnace.

Sintering was performed in a Rapid Temp 1500 Series batch laboratory furnace purchased from C.M., Inc., Bloomfield, NJ. The furnace heating chamber measured 10×10 inches (0.254×0.254 m) on the hearth, with a height of 8 inches (0.203 m). Heat is provided by electric molybdenum disilicide heating elements. The furnace was designed for use with protective atmospheres. Heat-up to 2,350° F. (1,290° C.) was achieved in approximately 15 minutes. The test parts were held at that temperature for 10 minutes. The cool down period was 2 hours to ensure that the parts were at a sufficiently low temperature to minimize oxidation of the parts when exposed to air.

The test parts were placed side by side on the mesh belt during pre-sintering. A stainless steel tray was used to hold the parts during sintering. The parts were laid flat on the tray in a single layer to minimize sticking.

Lubricant burn-off was performed in the belt-muffle furnace at a temperature of 1,400° F. (760° C.) throughout the hot zone. The atmosphere consisted of a 90% nitrogen, 10% hydrogen mixture that was humidified to a dew point of +10° F. to facilitate lubricant burn-off. A belt speed of 3 inches per min (7.6 cm/min) enabled the parts to stay in the hot zone for 35 minutes and allowed 45 minutes in the cooling zone which was sufficient to prevent oxidation during cooling.

The sintering tests were performed at consistent atmosphere flow rates and furnace temperatures. The only variable in the following 54 examples was the blend of nitrogen, hydrogen, carbon monoxide, and methane that was introduced at the sintering temperature. Carbon monoxide and methane ranged from 0 to 5% of the atmosphere blend. Hydrogen ranged from 0 to 75%. One test was performed to simulate endothermic gas with 40% hydrogen and 20% carbon monoxide in nitrogen. As each tray of test parts was sealed in the furnace at room temperature, 50 SCFH of nitrogen was introduced into the furnace and this atmosphere remained for the first 5 minutes of heat-up to ensure that the furnace was adequately purged. Furnace dew point at this initial heat-up ranged from −40° F. to −70° F.

After a 5 minute nitrogen purge, the test atmosphere blend was introduced at a total flow of 10 SCFH for the remainder of the heat-up cycle and well into the cooling cycle. A sintering temperature of 2,350° F. (1,290° C.) was maintained for 10 minutes. Typical furnace dew point at the sintering temperature ranged from −40° F. to −60° F.

The furnace was shut off after the parts had been held at the sintering temperature for 10 minutes. The parts were then allowed to cool. After about 15 minutes the atmosphere blend was replaced with a high flow (50 SCFH) of nitrogen to increase the rate of cooling. Hydrogen (2%) was added to maintain a reducing atmosphere in the furnace. After 2 hours of cooling, the parts were removed from the furnace.

Metallographic analysis of the parts sintered in the 54 different atmospheres showed the combined carbon readings of the core to be fairly constant. Chemical analysis showed that total carbon content also remained fairly constant. Although these core carbons remained constant throughout the testing, variations in surface carbons and carbon uniformity were evident for most atmosphere blends. The most visible effect of atmosphere changes had to do with the degree of carbon uniformity throughout the test parts. This information is summarized in Table III.

TABLE III

| | NITROGEN-BASED ATMOSPHERES | | | | | | |
|---|---|---|---|---|---|---|---|
| Example | $H_2$ | $CH_4$ | CO | Alloy 1 | Alloy 2 | Alloy 3 | Alloy 4 |
| 1 | — | — | — | A | U | A | A |
| 2 | 2 | — | — | A | U | A | U |
| 3 | 5 | — | — | A | SD | A | D |
| 4 | 10 | — | — | A | HD | D | D |
| 5 | 20 | — | — | A | A | A | D |
| 6 | 40 | — | — | A | D | A | A |
| 7 | 75 | — | — | A | HD | D | D |
| 8 | 40 | — | 20 | R | HD | A | A |
| 9 | — | — | 0.5 | A | D | A | D |
| 10 | — | — | 1 | A | U | A | U |
| 11 | — | — | 2 | A | D | U | U |
| 12 | — | — | 5 | SR | U | A | U |
| 13 | — | 0.5 | — | A | U | A | D |
| 14 | — | 1 | — | A | U | A | R |
| 15 | — | 2 | — | SR | HD | A | D |
| 16 | — | 5 | — | SR | N | N | N |
| 17 | 2 | — | 0.5 | A | A | A | A |
| 18 | 2 | — | 1.0 | A | D | A | A |
| 19 | 2 | — | 2 | A | A | A | D |
| 20 | 2 | — | 5 | A | A | D | U |
| 21 | 10 | — | 0.5 | A | A | A | D |
| 22 | 10 | — | 1 | A | A | A | A |
| 23 | 10 | — | 2 | A | A | A | SD |
| 24 | 10 | — | 5 | A | D | A | A |
| 25 | 2 | 0.5 | — | A | A | A | R |
| 26 | 2 | 1 | — | A | D | A | R |
| 27 | 2 | 2 | — | A | R | A | A |
| 28 | 2 | 5 | — | A | N | R | N |
| 29 | 10 | 0.5 | — | A | N | A | A |
| 30 | 10 | 1 | — | A | A | A | N |
| 31 | 10 | 2 | — | A | R | A | N |
| 32 | 10 | 5 | — | SR | HR | R | N |
| 33 | 10 | 0.5 | 0.5 | D | HR | D | A |
| 34 | 10 | 0.5 | 1 | A | A | R | D |
| 35 | 10 | 0.5 | 2 | A | D | D | D |
| 36 | 10 | 0.5 | 5 | A | A | A | D |
| 37 | 2 | 0.5 | 0.5 | SD | D | D | A |
| 38 | 2 | 0.5 | 1 | A | U | A | A |
| 39 | 2 | 0.5 | 2 | A | SR | A | A |
| 40 | 2 | 0.5 | 5 | A | D | A | A |
| 41 | 10 | 1 | 0.5 | A | N | A | N |
| 42 | 10 | 1 | 1 | A | A | A | N |
| 43 | 10 | 1 | 2 | A | U | A | D |
| 44 | 10 | 1 | 5 | A | A | A | N |
| 45 | 2 | 1 | 0.5 | A | A | A | A |
| 46 | 2 | 1 | 1 | A | U | U | A |
| 47 | 2 | 1 | 2 | A | A | A | A |
| 48 | 2 | 1 | 5 | A | R | A | A |
| 49 | 10 | 2 | 0.5 | A | N | U | N |
| 50 | 10 | 2 | 2 | A | R | N | R |
| 51 | 10 | 2 | 5 | A | R | U | SR |

TABLE III-continued

| | NITROGEN-BASED ATMOSPHERES | | | | | | |
|---|---|---|---|---|---|---|---|
| Example | $H_2$ | $CH_4$ | CO | Alloy 1 | Alloy 2 | Alloy 3 | Alloy 4 |
| 52 | 2 | 2 | 0.5 | SR | SR | R | R |
| 53 | 2 | 2 | 1 | A | R | A | R |
| 54 | 2 | 2 | 2 | A | R | U | R |

A = acceptable uniformity
U = high uniformity
N = non-uniformity
D = decarburization
R = recarburization
SD = slight decarburization
HD = heavy decarburization
SR = slight recarburization
HR = heavy recarburization In view of Table III, the following paragraphs comprise general statements which can be made concerning sintering atmospheres outside the scope of the inventive process:

Increasing the hydrogen content in the atmosphere resulted in increasingly non-uniform carbon, as evidenced by lower carbon areas. Surface decarburization became heavy as the amount of hydrogen approached 75%. The carbon loss caused by the hydrogen is presumably due to the combination of the hydrogen with the carbon from the parts to form methane. The hydrogen may also slightly increase the furnace dew point due to the reduction of oxides in the furnace refractory. Therefore, decarburization will result.

Additions of carbon monoxide to nitrogen produce non-uniform carbon. Areas of high carbon were evident for the higher carbon monoxide concentration (5%). Methane additions produced similar results, but with more pronounced recarburization. Higher methane levels also caused severe sooting on the furnace walls although all parts were soot-free.

Hydrogen additions to both nitrogen-methane and nitrogen-carbon monoxide blends resulted in a relatively more uniform carbon distribution in some compacts. Nitrogen based atmospheres consisting of 2% hydrogen and small amounts of carbon monoxide (1% to 2%) produced several uniform carbon profiles. Surprisingly, low carbon areas were still evident, however, when carbon monoxide was blended with higher hydrogen concentrations.

Also unexpectedly, decarburization was evident with 10% hydrogen in nitrogen even though as much as 5% carbon monoxide was used. These results indicate that the carburizing effects of small additions of hydrogen can be controlled by carbon monoxide. The carbon monoxide provides sufficient carbon potential to hold uniform carbon with 2% hydrogen in nitrogen, but carbon monoxide cannot provide a sufficient carbon potential to hold carbon with 10% hydrogen and nitrogen.

In a similar analysis which supported the above unexpected results, small additions of methane (0.5% to 1%) with 10% hydrogen and nitrogen resulted in relatively more uniform carbon profiles than were achieved with carbon monoxide in 10% hydrogen or 10% hydrogen alone in nitrogen. The higher carbon potential and carburizing rate of methane is sufficient to eliminate the low carbon areas found with the higher hydrogen atmospheres. When combined with low hydrogen levels however the methane tended to recarburize. In general, carbon monoxide additions provided a more uniform carbon than did methane additions. Heavy recarburization occurs with 2% methane and 2% hydrogen in nitrogen. It should be noted that atmospheres containing methane produced slightly higher combined carbon levels than those atmospheres containing the same amount of carbon monoxide.

More importantly, Table III shows that protective atmospheres of the inventive process afforded substantially uniform carbon profiles as discussed hereinafter.

Specifically, runs in which the high temperature sintering atmosphere comprised hydrogen, methane, and carbon monoxide within the designated ranges for the process of this invention are Examples 37–39 and 45–47. In general the bars of the 4 alloys tested gave acceptable uniform carbon distribution with the alloy 2 test bar in Example 38 and the test bars of alloys 2 and 3 in Example 46 demonstrating highly uniform carbon distribution.

In Example 39 the atmosphere comprising 2% hydrogen, 0.5% methane and 2% carbon monoxide gave acceptable uniform carbon distribution for alloys 1, 3 and 4 with alloy 2 showing slight recarburization. However, alloy 2 showed highly uniform carbon distribution in Example 38 when the carbon monoxide concentration was 1% with the hydrogen and methane levels remaining the same. Alloy 2 also demonstrated acceptable uniform carbon distribution in Example 47 when the methane concentration was increased to 1% while the hydrogen and carbon monoxide level were maintained at 2%.

Example 37, in which the protective atmosphere comprised hydrogen, methane and carbon monoxide in concentrations at about the minimum of the ranges for the inventive process, gave decarburization for alloys 1, 2 and 3 and acceptable carbon uniformity for alloy 4. By slightly increasing either the carbon monoxide concentration to 1% as in Example 38, or the methane concentration to 1% as in Example 45, all four alloys gave sintered compact parts having acceptable uniform carbon distribution. Accordingly, when it is contemplated using a protective atmosphere comprising hydrogen, methane and carbon monoxide at about the minimum of their respective ranges, namely hydrogen (2%), methane (0.5%) and carbon monoxide (0.5%), the level of either methane or carbon monoxide should be slightly greater than 0.5%.

Generally, Examples in which one of the gaseous components fell outside of the recommended limits for the protective atmosphere blend resulted in at least one of the samples exhibiting non-uniform carbon distribution, i.e., recarburization or decarburization. For instance, the atmosphere of Example 18 contained no methane and gave decarburization with alloy 2. Runs in which the protective atmosphere contained no carbon monoxide yielded recarburization in alloy 4 (Examples 25 and 26), and decarburization in alloy 2 (Example 26). Examples 33–35, which had 10% hydrogen and 0.5% methane with carbon monoxide within the recommended limits, showed predominantly decarburization of the alloy compacts. Examples 41–43, which contained 10% hydrogen and 1% methane with carbon monoxide within the recommended range, afforded several sintered alloy compacts having non-uniform carbon distribution. And finally, Examples 52–54, which contained 2% methane with hydrogen (2%) and carbon monoxide (0.5 to 2%) within the limits, gave predominantly sintered alloy compacts evidencing recarburization.

In addition, the high temperature sintering of these ferrous powder metallurgy compacts yielded products possessing very good transverse rupture strength. These higher processing temperatures increase the rate of pore spheroidization which is associated with increases in the strength of a powder metallurgy part.

To achieve the maximum benefits of sintering ferrous powder metallurgy compacts in nitrogen based atmospheres at high temperature, a reducing atmosphere of neutral carburizing potential must be used to produce a uniform carbon structure of high carbon content.

Nickel or copper additions to ferrous powder tended to stabilize carbon in the material and reduce the decarburizing tendency of hydrogen. In so doing, carbon monoxide can form a uniform carbon profile more readily and this allows small additions of methane to be added in order to increase the strength of the material without significant recarburization. With respect to alloy 3 which contained a nickel addition, combinations of carbon monoxide, methane and 2% hydrogen in nitrogen resulted in high uniform carbon profiles while carbon monoxide, methane and 10% hydrogen in nitrogen produced lower core carbons. With respect to alloy 4 which contained a copper addition, hydrogen and carbon monoxide in nitrogen produced uniform carbon profiles even with 0.5 to 1% methane additions.

Generally, the four component protective atmosphere used in the inventive process offers the following features: (1) a high nitrogen content to provide a consistent carrier gas that is neutral to carbon and non-oxidizing; (2) a low hydrogen content to provide adequate reducing potential while minimizing decarburization by hydrogen; (3) a low carbon monoxide level to provide a carbon potential with a slower carburizing rate than methane while allowing the use of lower hydrocarbon additions; and (4) smaller hydrocarbon additions to increase carbon potential beyond that obtainable with carbon monoxide. By minimizing hydrocarbon addition, the recarburization effect is minimized.

The disclosed protective atmosphere composition affords additional advantages to the high temperature sintering process. Many methods of producing carbon monoxide and hydrogen also produce carbon dioxide and water as impurities. By utilizing lower levels of carbon monoxide and hydrogen, lower levels of carbon dioxide and water also result. In proper proportion, lower levels of carbon monoxide, carbon dioxide, hydrogen and water reduce the tendency to decarburize or carburize and result in a more neutral protective atmosphere. The lower hydrocarbon levels minimize the effect of inconsistencies, such as peak shaving, in the hydrocarbon supply.

This more neutral protective atmosphere results in more uniform carbon content in the compacts which in turn decreases the dimensional variation among parts and improves the physical properties.

STATEMENT OF INDUSTRIAL APPLICATION

The process of this invention provides a means for attaining a uniform carbon distribution in ferrous powder metallurgy compacts at sintering temperatures above about 2,200° F. (1,204° C.). In addition, such high temperature sintered parts show improved impact strength and have the potential for expanding the field of powder metallurgy because parts so processed can be substituted for all but the most demanding forgings and also for nodular iron castings.

We claim:

1. A process for high temperature sintering which provides a substantially uniform carbon distribution in a ferrous powder metallurgy compact, which process comprises:

(a) heating the ferrous powder metallurgy compact in the heating zone of a sintering furnace to a temperature of at least 2,200° F., (b) introducing into the heating zone an atmosphere comprising about 2 to less than 10 volume percent hydrogen, about 0.5 to 2.0 volume percent carbon monoxide, about 0.5 to 1.0 volume percent methane, the level of either the carbon monoxide or the methane being at least slightly greater than 0.5 volume percent when the other is about 0.5 volume percent and the hydrogen is about 2 volume percent, and the balance nitrogen, and (c) removing the sintered compact.

2. The process of claim 1 in which a mixture comprising nitrogen, methanol and 0.5 to 1.0 volume percent methane is introduced into the heating zone, the nitrogen and methanol being in such proportion to afford when subjected to the high temperature in the heating zone the atmosphere of step (b).

3. The process of claim 1 in which the ferrous powder metallurgy compact is heated to a temperature from about 2,300° to 2,550° F.

4. The process of claim 1, 2 or 3 in which hydrogen content of the atmosphere is about 2 to 6 volume percent.

5. The process of claim 4 in which the hydrogen content of the atmosphere is about 2 to 4.5 volume percent.

6. The process of claim 1, 2 or 3 in which the ferrous powder metallurgy compact has a medium to high combined carbon content of at least 0.4%.

7. The process of claim 3 in which the ferrous powder metallurgy compact contains copper or nickel.

8. A process for high temperature sintering which provides a substantially uniform carbon distribution in a ferrous powder metallurgy compact having a medium to high combined carbon content of at least 0.4%, which process comprises:

(a) heating the ferrous powder metallurgy compact in the heating zone of a sintering furnace to a temperature from about 2,300° to 2,550° F., (b) introducing to the heating zone an atmosphere comprising about 2 to less than 10 volume percent hydrogen, about 0.5 to 2.0 volume percent carbon monoxide, about 0.5 to 1.0 volume percent methane, the level of either the carbon monoxide or the methane being a least slightly greater than 0.5 volume percent when the other is about 0.5 volume percent and the hydrogen is about 2 volume percent, and the balance nitrogen, and (c) removing the sintered compact.

* * * * *